US007676054B2

(12) United States Patent
Setiabudi et al.

(10) Patent No.: US 7,676,054 B2
(45) Date of Patent: Mar. 9, 2010

(54) CONTOURED PASSIVE RADIATOR AND LOUDSPEAKER INCORPORATING SAME

(75) Inventors: J. Dwidjaja Setiabudi, Kudus (ID); Adisusanto, Kudus (ID); Setiawan Yusran, Kudus (ID); Andi Sudaryono, Kudus (ID); Hadi Prayitno, Kudus (ID); Indrayana, Kudus (ID); Tartoyo, Kudus (ID)

(73) Assignee: PT. Hartono Istana Teknologi, Kudus (ID)

( * ) Notice: Subject to any disclaimer, the term of this patent is extended or adjusted under 35 U.S.C. 154(b) by 1071 days.

(21) Appl. No.: 11/226,372

(22) Filed: Sep. 15, 2005

(65) Prior Publication Data

US 2007/0058830 A1 Mar. 15, 2007

(51) Int. Cl.
*H04R 1/00* (2006.01)

(52) U.S. Cl. ..... 381/423; 381/430

(58) Field of Classification Search ..... 381/423, 381/424, 430; 181/144, 145, 146, 147, 163, 181/164, 165, 148, 153, 157
See application file for complete search history.

(56) References Cited

U.S. PATENT DOCUMENTS

| | | | | |
|---|---|---|---|---|
| 5,570,429 | A * | 10/1996 | Paddock | 381/423 |
| 5,892,184 | A | 4/1999 | D'Hoogh | |
| 6,169,811 | B1 | 1/2001 | Croft, III | |
| 6,176,345 | B1 | 1/2001 | Perkins et al. | |
| 6,658,129 | B2 | 12/2003 | D'Hoogh | |

* cited by examiner

*Primary Examiner*—Brian Ensey
(74) *Attorney, Agent, or Firm*—Rothwell, Figg, Ernst & Manbeck, P.C.

(57) ABSTRACT

A passive radiator has an arcuate contour that follows the contour of a surface where the passive radiator can be mounted. The component may be for example a television set, audio component, high fidelity loudspeaker, home theatre loudspeaker, or subwoofer. The arcuate contour of the passive radiator may be convex, parabolic, hyperbolic, or a combination thereof. Furthermore, the contour of the surface may be cylindrical, spherical or another contour depending on the surface contour of the enclosure where it is mounted. The passive radiator rim shape may be circular, rounded, rectangular, ovular, elliptical or any other suitable shape. A contoured passive radiator of relatively large size can be mounted on a relatively small TV set to produce a better bass sound.

30 Claims, 15 Drawing Sheets

6a
(prior art)

CONTOURED PASSIVE RADIATOR AND LOUDSPEAKER INCORPORATING SAME

FIELD OF THE INVENTION

The present invention relates to electroacoustics and more particularly to loudspeaker systems with contoured passive radiators.

BACKGROUND OF THE INVENTION

Modern television monitors require a high quality picture with clear sound, transparent treble and deep powerful bass.

To achieve deep low frequency bass, a subwoofer system is required inside the television set enclosure. In view of the fact that enclosure space is limited in modern sets, the bass produced sounds weak and the performance is unsatisfactory.

Passive radiator loudspeaker systems are an improvement over the conventional bass reflex system. The systems do not produce turbulent sound at the port of the bass reflex system and radiate reflected sound from inside the enclosure. This colors the sound quality. Furthermore, port length can present a problem in small enclosures. The frequency response of the system can be easily tuned with the appropriate speaker diaphragm size, weight and compliance of the passive radiator. As for loudspeaker diaphragm and bass reflex tube cross-sectional size, the greater the size of passive radiator, the higher the sound pressure level (SPL).

The advantage of a passive radiator system over a bass reflex system in television enclosures was discussed in U.S. Pat. Nos. 5,892,184 and 6,658,129. D'Hoogh's passive radiator is not contoured and as a result it does not provide an optimum bass sound pressure level.

One of the important loudspeaker specifications is polar directivity. At high frequencies, the sound is very directional toward the front and strong on axis. At mid frequencies, the sound is less directional and spreads sideways. The lower the frequency, the wider the spreading, while the front intensity is the strongest. The sound one hears from a loudspeaker is influenced by the placement of the loudspeaker. Generally, the listening room has more parallel walls that produce a phenomenon known as standing waves. The existence of standing wave patterns produces irregularity in the sound pressure level in various places within the room. This effect can be easily heard from the bass sound. This irregularity can be minimized by using various acoustic devices such as combination of absorbers, diffusers, bass traps, etc. Although useful, these devices increase the cost of the unit.

The present invention overcomes the drawbacks of the prior art with a contoured passive radiator design. The contour of the radiator follows the contour of the television enclosure where the radiator is mounted. As a result, the passive radiator size can be maximized. For example, a contoured passive radiator equivalent to 8" diameter or larger can be mounted on a small 14" television set. For large televisions, for example 29", a contoured passive radiator equivalent to a 10" diameter or larger may be used.

By making use of a contoured passive radiator, the above disadvantages can be alleviated. The contoured passive radiator is less directional compared to a conventional diaphragm. The sound spreads in a wider direction, hence reducing the irregularity of the SPL of the bass sound. The invention is applicable for use in audio components, high fidelity loudspeakers, subwoofers and other loudspeaker systems.

SUMMARY OF THE INVENTION

One object of one embodiment of the present invention is to provide an improved passive radiator.

The improved passive radiator can fit the contour of the audio or video enclosure having a plurality of arcuate contours and a plurality of rim shapes for following a contour of the enclosure. The plurality of arcuate contours comprises a contour selected from the group consisting of convex contour, parabolic contour, hyperbolic contour or a combination thereof. Furthermore, the convex surface of the radiator can be cylindrical, spherical, or other contour depending on surface contour of the enclosure where it is mounted. The passive radiator rim shapes may be circular, rounded rectangular, ovular, elliptical or any other suitable shape. The arrangement can be used in a television set, audio video component, high fidelity loudspeaker, home theater loudspeaker, subwoofer, etc.

A further object of one embodiment of the present invention is to provide a passive radiator for use in an audio or video component having an enclosure and means for retaining a loudspeaker driver, the radiator for increasing the sound pressure level of sound delivered by the loudspeaker, the radiator comprising a passive radiator diaphragm having an arcuate contour for following a contour of the enclosure, a supporting frame extending around the diaphragm and a surround member connected to the frame and the diaphragm to permit compliance of the diaphragm.

Another object of one embodiment of the present invention is to provide a passive radiator for use in an audio or video component having an enclosure and means for retaining a loudspeaker driver, the radiator for increasing the sound pressure level of sound delivered by the loudspeaker, the radiator comprising a passive radiator diaphragm having an arcuate contour for following a contour of the enclosure, a supporting frame extending around the diaphragm, a surround member connected to the frame and the diaphragm to permit compliance of the diaphragm, a spider and a hollow structure connected to the spider and the supporting frame.

A further object of the present invention is to provide a contoured passive radiator having a relatively large passive radiator diaphragm. As an example, a contoured passive radiator equivalent to 8" diameter can be mounted on a small television set of 14". For a large size television set, i.e. 29" or larger, use of a contoured passive radiator equivalent to 10" diameter or larger may be employed.

Yet another object of one embodiment of the present invention is provide a method of increasing the bass frequency sound pressure level of a loudspeaker within an enclosure, comprising providing a loudspeaker enclosure having a loudspeaker driver mounted therein, providing a passive radiator having a diaphragm and support means therefore, the diaphragm having an arcuate contour and compliant upon exposure to a signal, mounting the passive radiator into the loudspeaker enclosure, and passing a bass signal through the loudspeaker driver whereby the sound pressure level of the output of the loudspeaker driver is increased.

A further object of the present invention is to provide a loudspeaker system with a high bass sound pressure level that does not produce sound distortion due to turbulent sound at the port, using a contoured passive radiator which follows the contour of loudspeaker enclosure similarly or identically.

Having thus generally described invention, reference will now be made to the accompanying drawings.

DETAILED DESCRIPTION OF THE PREFERRED EMBODIMENTS

Figure 1A:
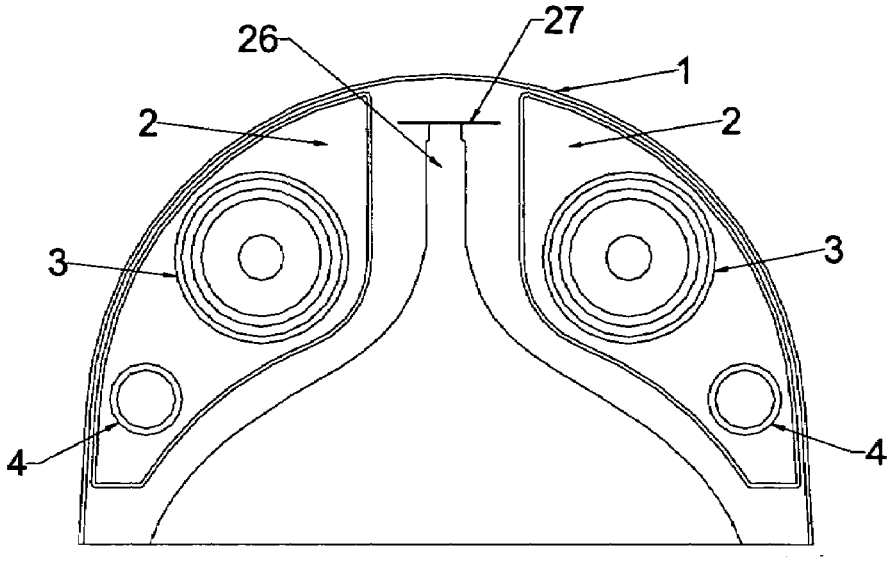
Figure-1a (Prior Art)
FIG. 1*a* is a top cross-sectional view of a conventional loudspeaker television enclosure with a bass reflex system.
Figure 1B:
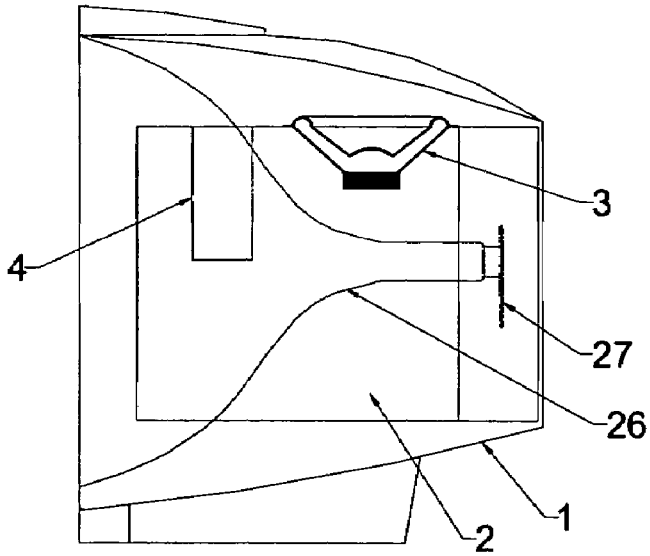
Figure-1b (Prior Art)
FIG. 1*b* is a side view of FIG. 1*a;*

Referring to FIGS. 1*a* and 1*b*, shown are views of the conventional television loudspeaker enclosure having a bass reflex system known from the prior art. The television has a CRT 26 with a CRT module board 27 and a curved back 1. In the example, two loudspeaker enclosures 2 are provided. Each loudspeaker enclosure has a woofer loudspeaker 3 and bass reflex port 4. The frequency response of the system is tuned with the appropriate enclosure volume, loudspeaker parameters, bass reflex port area and length. The bass reflex method has disadvantages, one of which is sonic distortion with high powered signals.

Figure 2A:
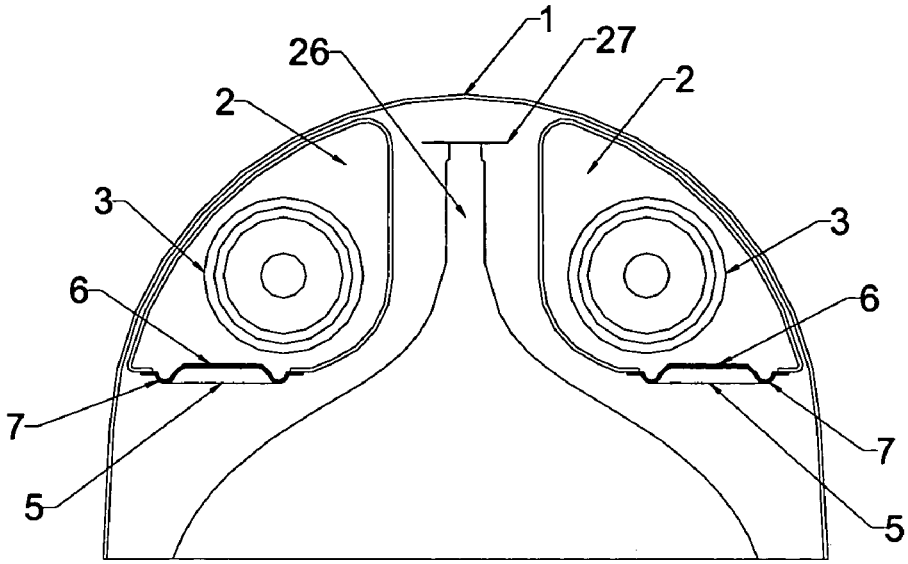
Figure-2a (Prior Art)
FIG. 2*a* is a top cross-sectional view of a conventional loudspeaker television enclosure with a passive radiator system.
Figure 2B:
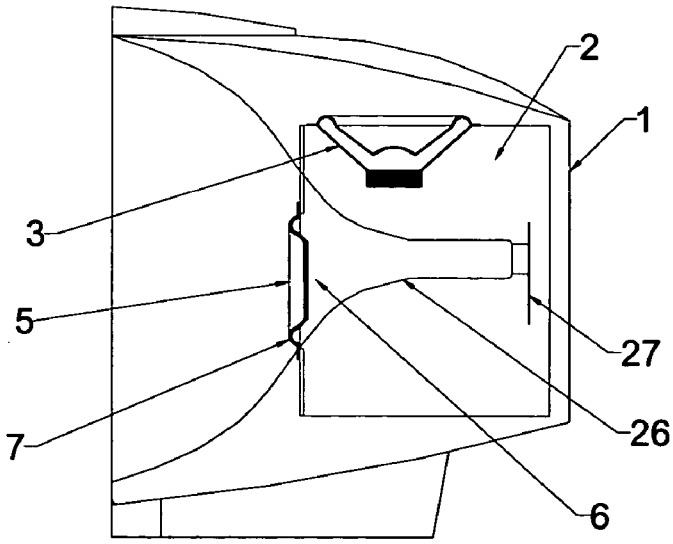
Figure-2b (Prior Art)
FIG. 2*b* is a side view of FIG. 2*a;*

Referring now to FIGS. 2*a* and 2*b*, shown are a top view and side view of the loudspeaker enclosure known from the prior art. Use is made of a passive radiator 5 instead of the bass reflex system. The passive radiator has a passive radiator diaphragm 6 and passive radiator surround member 7. Sound distortion due to turbulent sound at the port of the bass reflex system, reflecting sound from inside the box which colors the sound quality can be minimized with the arrangement. The frequency response of the system can be easily tuned with the appropriate enclosure volume 2, parameter of the woofer loudspeaker 3, compliance of passive radiator surround 7 and passive radiator area and weight 5.

Although useful, the SPL of such systems is influenced by the area of passive radiator. The greater the size, the higher sound pressure level. Due to the placement of the prior art passive radiators inside the television enclosure, passive radiator area is limited. As a result, optimum bass sound pressure level is not achieved.

Figure 3:
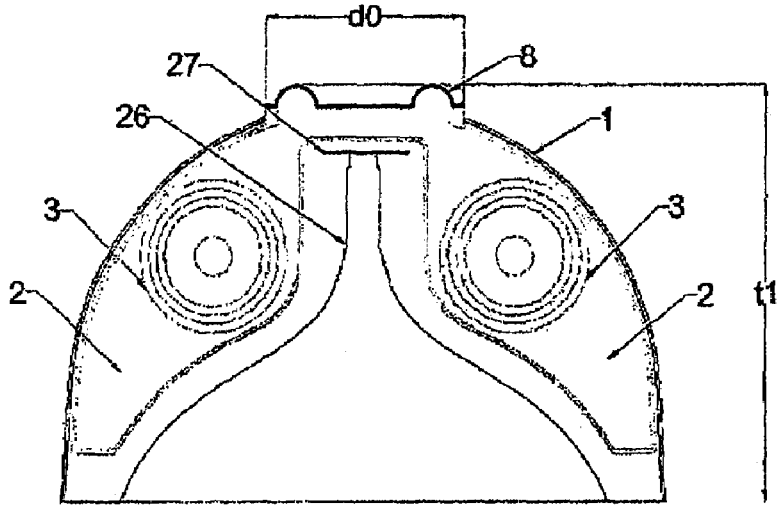
Figure 3 (Prior Art)
FIG. 3 is a top cross-sectional view of conventional loudspeaker television enclosure with a passive radiator positioned at the back of the television.

Referring to FIG. 3, shown is a passive radiator loudspeaker enclosure known in the art, with a passive radiator 8 at the back of television set 1 with two loudspeakers 3 inside television set 1. When the depth of television set is $t_1$ and the contour of television set 1 similar to FIG. 2*a*, it is evident that the area of passive radiator $d_0$ is limited.

It is known that the larger the size of a loudspeaker diaphragm, the greater the volume of air movement and the higher the sound pressure level. This is also true in passive radiator systems where, in order to obtain appropriate frequency response, the weight and compliance of passive radiator diaphragm can be chosen.

Figure 4A:
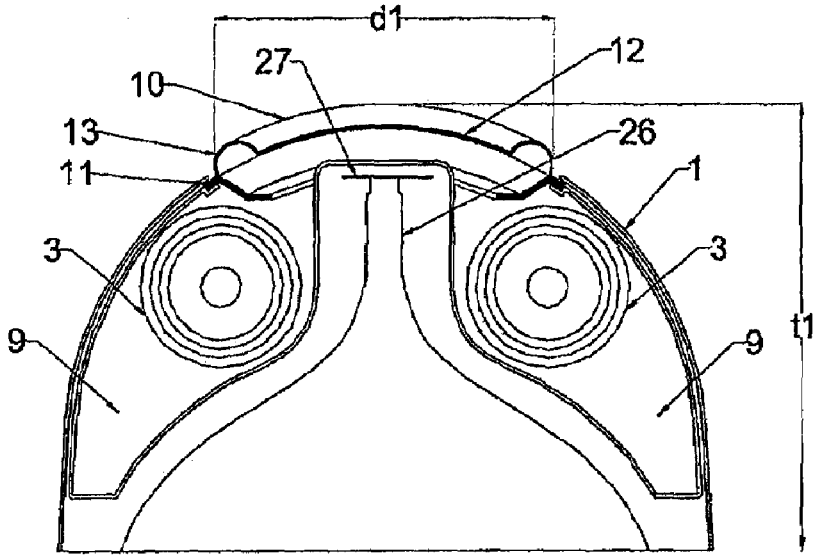
FIG. 4*a* is a top cross-sectional view of one embodiment of a loudspeaker television enclosure according to the present invention, the position of the contoured passive radiator being at the back of the television.

Referring to FIG. 4*a*, shown is a television set having a contoured back and a depth $t_1$ according to the present invention. Numeral 9 denotes a pair of enclosures each having a contoured back surface and a woofer loudspeaker 3. Numeral 10 denotes a contoured passive radiator which follows the contour of the back of the television. The passive radiator has a supporting frame 11, passive radiator diaphragm 12 having high rigidity surround member 13 with a circular shape and relatively large radius; this results in optimum compliance under significant movement of the passive radiator. The frequency response of the contoured passive radiator loudspeaker system depends on the volume of the television enclosure 9, parameter of the woofer driver 3, compliance of passive radiator sound element 13 and the weight of passive radiator 10.

Figure 4B:
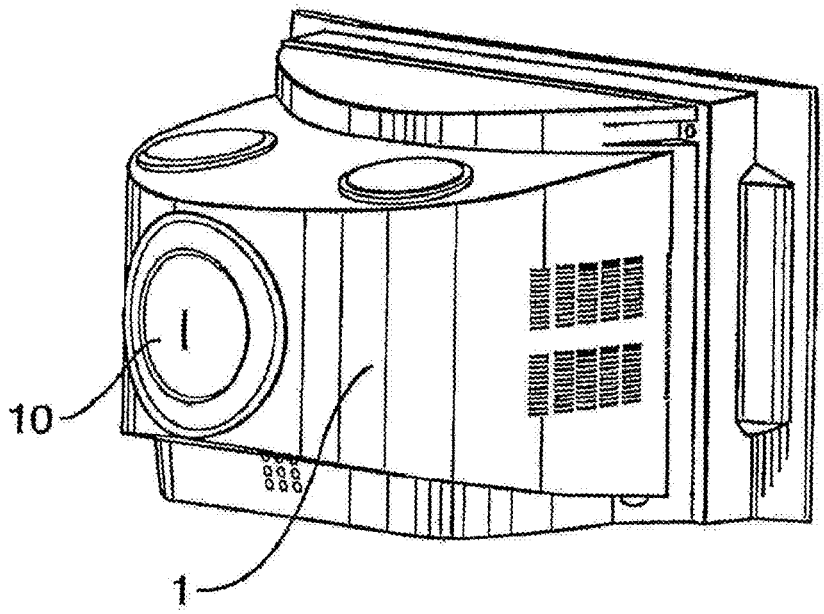
FIG. 4*b* is an example of a perspective view of a television incorporating the contoured passive radiator.

FIG. 4*b* is a perspective view of the television set 1, with the position of the contoured passive radiator 10 at the back of the television set 1.

Although the contour and the depth of television enclosure $t_1$ is somewhat similar to the prior art passive radiator in FIG. 3, the area of the passive radiator according to the present invention is larger by following the shape or contour of the television set enclosure as opposed to simply mounting on it, the latter being known in the art. A passive radiator of 8" diameter can be mounted on a small television set of 14". For larger television sets, for example 29" and greater, use of a contoured passive radiator equivalent to 10" diameter or larger may be employed.

Figure 5:
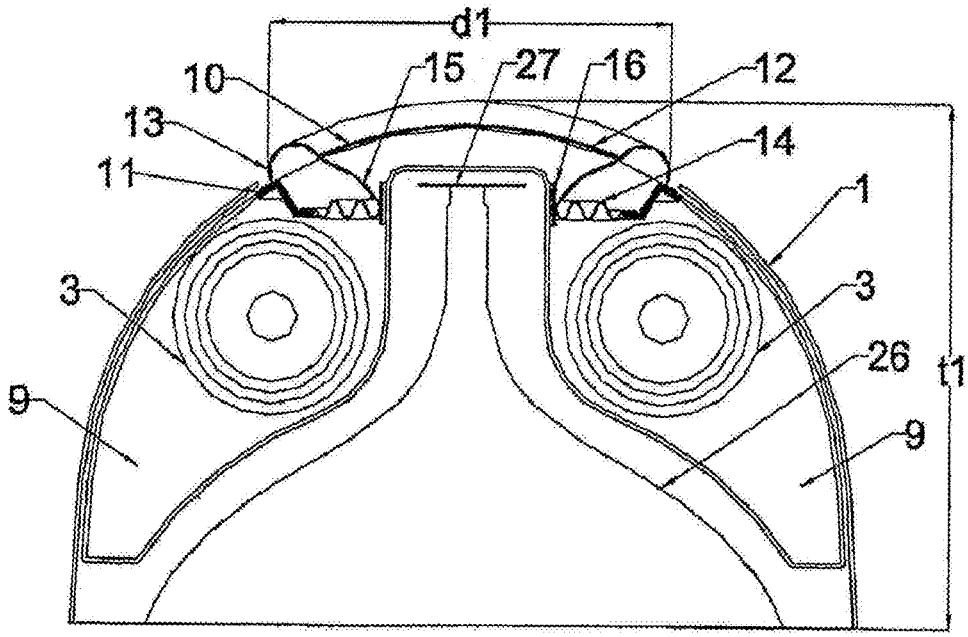
FIG. 5 is a top cross-sectional view of another embodiment of a television enclosure according to the present invention for high power sound with the position of the contoured passive radiator at the back of the television.
Figure 12:
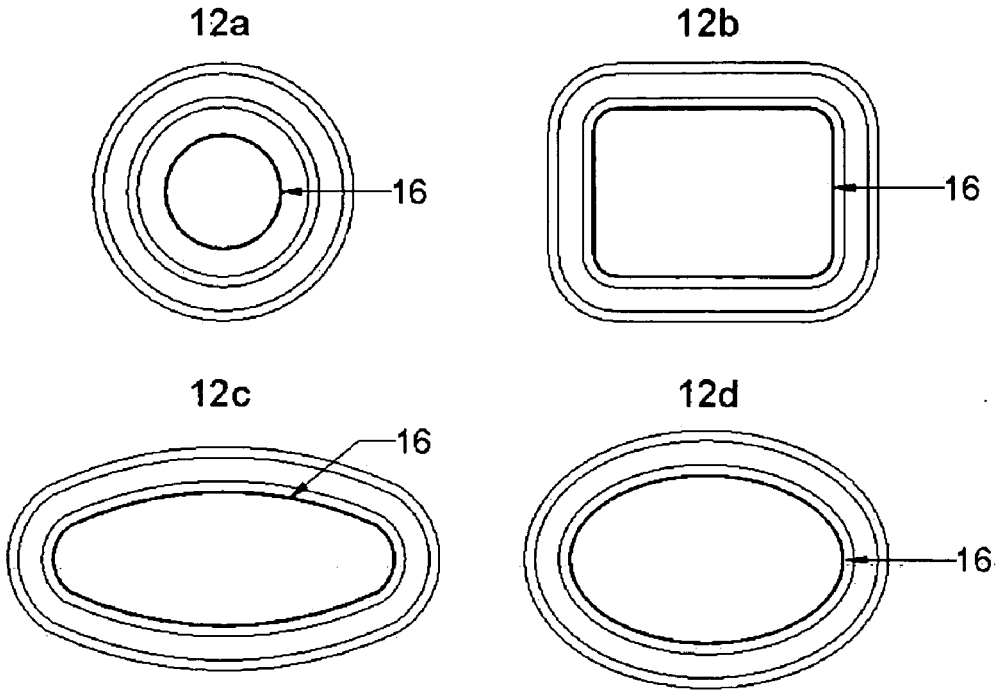
FIGS. 12*a*-12*d* are illustrations of hollow structures for use with the spider.

Referring now to FIG. 5, for enhanced audio power, a spider 14 is added. This is connected to a supporting diaphragm 15 through a hollow structure 16. The purpose of the spider is to reduce the sound distortion due to nonlinear movement. The cross-section of the hollow structure may be circular, square, a rounded rectangle, oval or any other suitable shape, having a relatively large dimension for placing CRT board 27 inside. Details of the hollow structure are shown in FIG. 12.

An important loudspeaker specification is sound directivity or polar directivity. At high frequencies, the sound is very directional toward the front and is strong on axis. At mid-frequencies the sound is less directional and spreads sideways or laterally. The lower the frequency, the wider the spreading, although front intensity remains strong.

Generally, placement of the television set is usually some distance from a wall. Sound from the passive radiator at the back of television set is reflected by the wall. As a result, a listener can hear both original sound and reflected sound. Since the wavelength of bass sound is greater than the distance between the television set and the wall, the phase difference between the original and the reflected sound is negligible and the total sound pressure level is higher.

As discussed previously, most listening rooms have parallel walls and this creates standing waves. The standing wave will distort the bass sound and produce an irregular sound pressure level in various places within the room. By making use of the present invention, this can be minimized.

Figure 6:
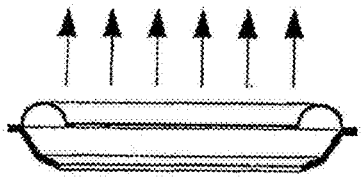
FIG. 6*a* is a schematic illustration of the sound directivity of a conventional passive radiator.
FIG. 6*b* is a schematic illustration of the sound directivity for a contoured passive radiator.
Figure 6:
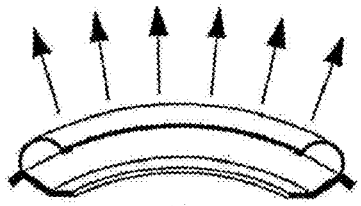

FIGS. 6*a* and 6*b* depict the difference of sound directivity of the prior art passive radiator (FIG. 6*a*) and the contoured passive radiator of the present invention (FIG. 6*b*). The contoured passive radiator has wider sound directivity, hence reducing irregular sound pressure level of the bass.

Figure 7:
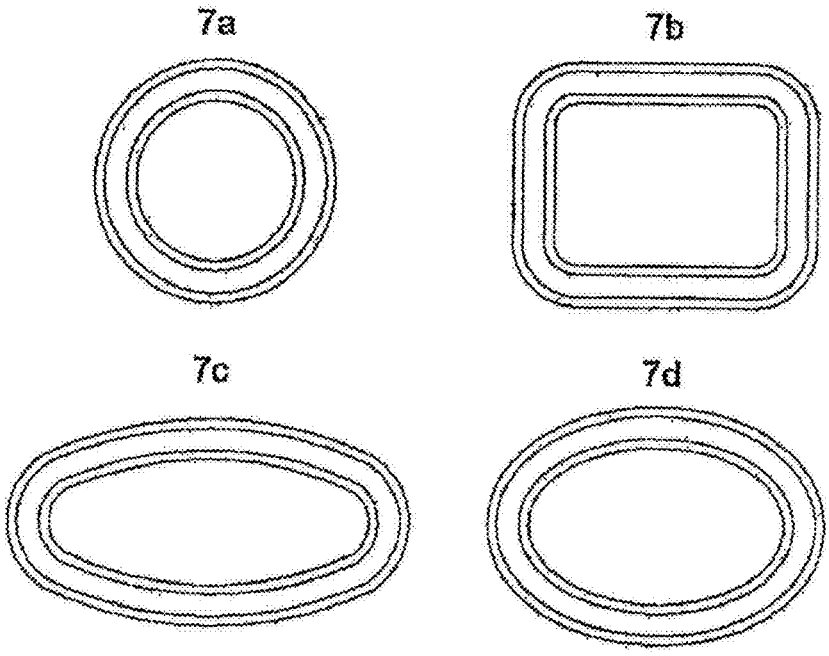
FIGS. 7*a*-7*d* are plan views of shapes for the passive radiator rim.

A variety of shapes for the passive radiator rim shape are possible. The shape following the form or contour of the loudspeaker enclosure in which the passive radiator is mounted may be, for example, circular (FIG. 7*a*), a rounded rectangle (FIG. 7*b*) ovular (FIG. 7*c*), elliptical (FIG. 7*d*) or other suitable shape which achieve the desired results. The passive radiator diaphragm shape may be convex, parabolic, hyperbolic, etc. Furthermore, the convex surface can be cylindrical, spherical or other suitable contour depending on surface contour of the enclosure where it is mounted. This is in contrast to the prior art passive radiators having a flat surface.

Figure 8A:
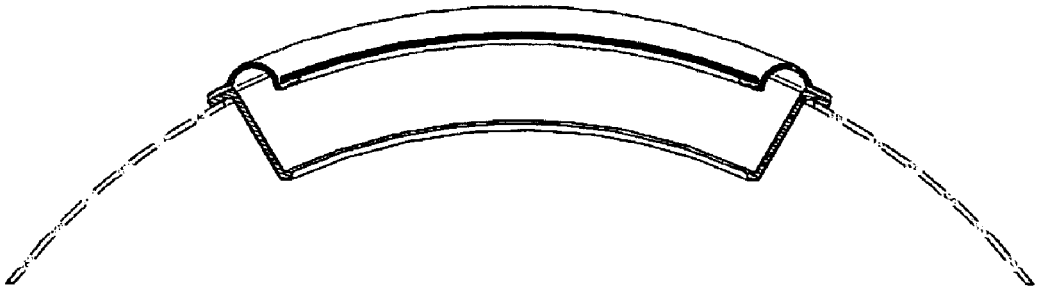
FIGS. 8*a*-8*d* are top cross-sectional and side cross-sectional views of examples of the surface contours of the contoured passive radiator.
Figure 8B:
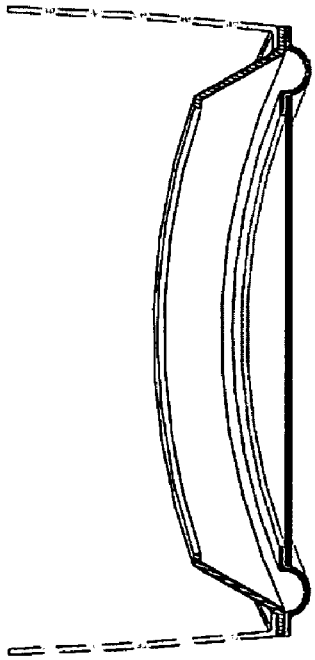
Figure 8C:
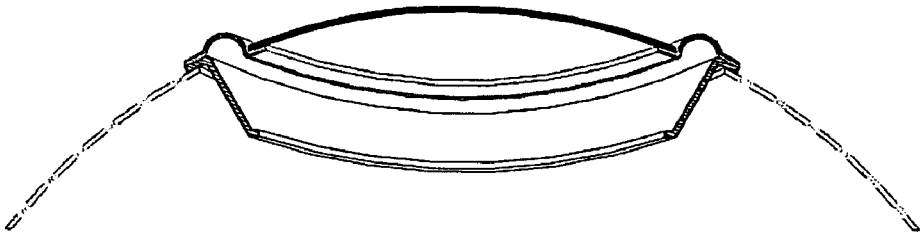
Figure 8D:
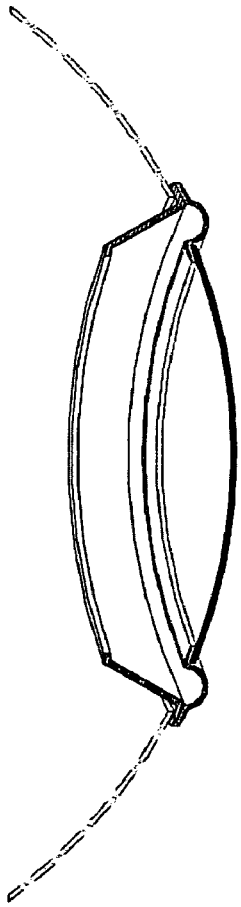

FIGS. 8*a* through 8*d* illustrate the possible arcuate contours of the passive radiator according to the invention. Examples include cylindrical top cross-sectional view (FIG. 8*a*), cylindrical side cross-sectional view (FIG. 8*b*), spherical top cross-sectional view (FIG. 8*c*) and spherical side cross-sectional view (FIG. 8*d*). Provided the contour is not flat, i.e. 180°, the desirable sonic benefits are realized.

Figure 9A:
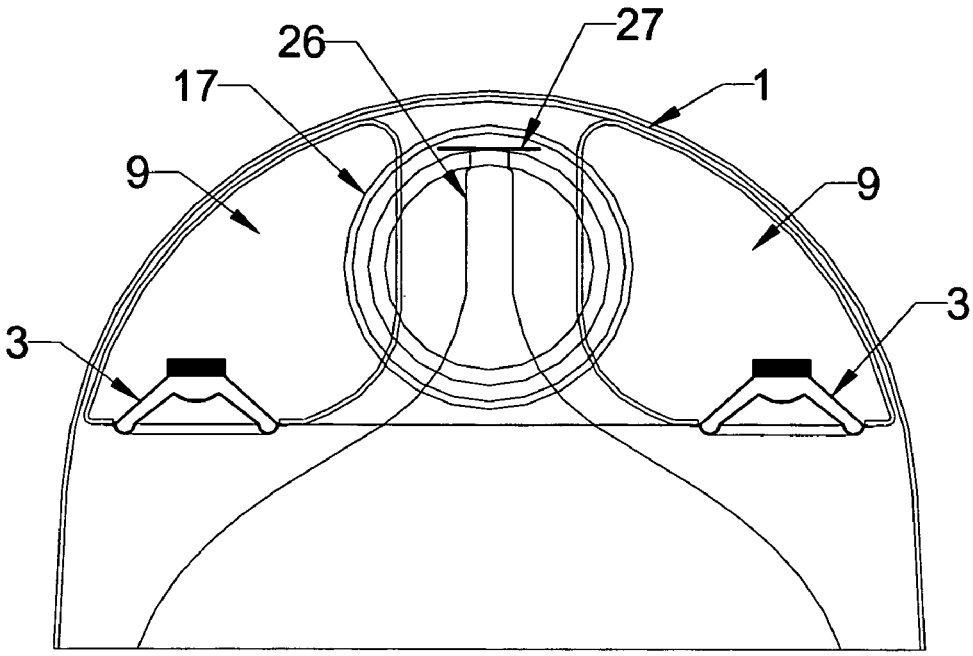
FIG. 9*a* illustrates a top cross-sectional view of a television enclosure incorporating the contoured passive radiator according to the present invention.
Figure 9B:
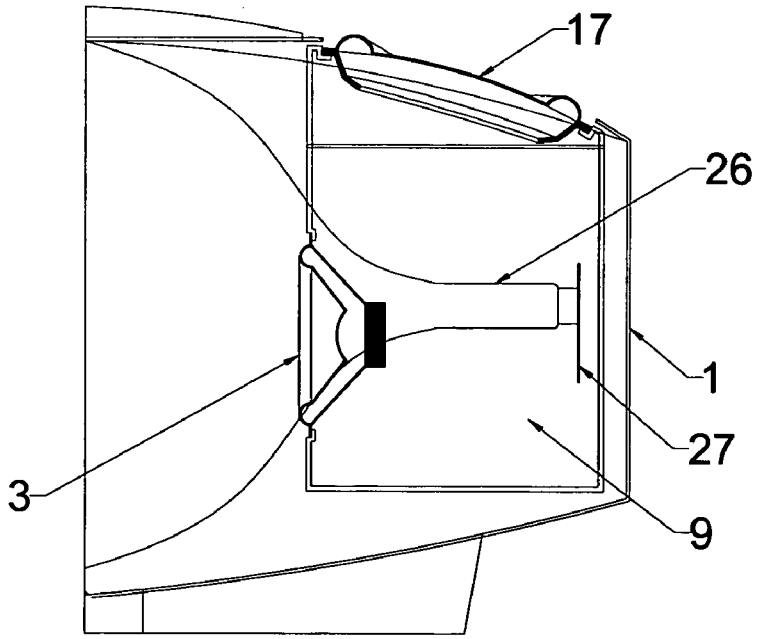
FIG. 9*b* illustrates a side cross-sectional view of a television enclosure incorporating the contoured passive radiator according to the present invention.

An alternative placement of the passive radiator is at the top of the television 17 (FIG. 9*a*) shown in a side view at FIG. 9*b*. Each woofer enclosure 9 has a woofer driver 3. This arrangement is useful for bookshelf systems.

Figure 10:
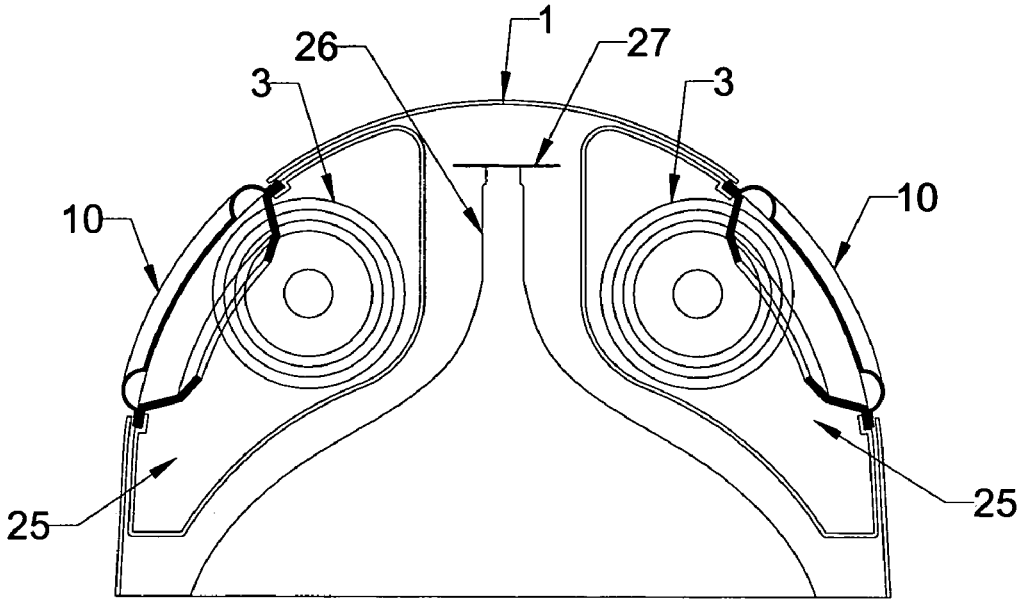
FIG. 10 is a top plan view of an embodiment of a loudspeaker television enclosure with a contoured passive radiator according to the present invention, positioned at both sides of the television.

FIG. 10 illustrates the placement of the passive radiator 10 at the side of television set having a contoured side surface 1. Numeral 25 denotes a pair of loudspeaker enclosures. Each enclosure has a frame for supporting contoured passive radiator 10 and a woofer driver 3. Comparing the prior art in FIG. 2*a*, it can be seen that the area of the passive radiator in accordance with the present invention is larger. This results in a higher sound pressure level.

Figure 11:
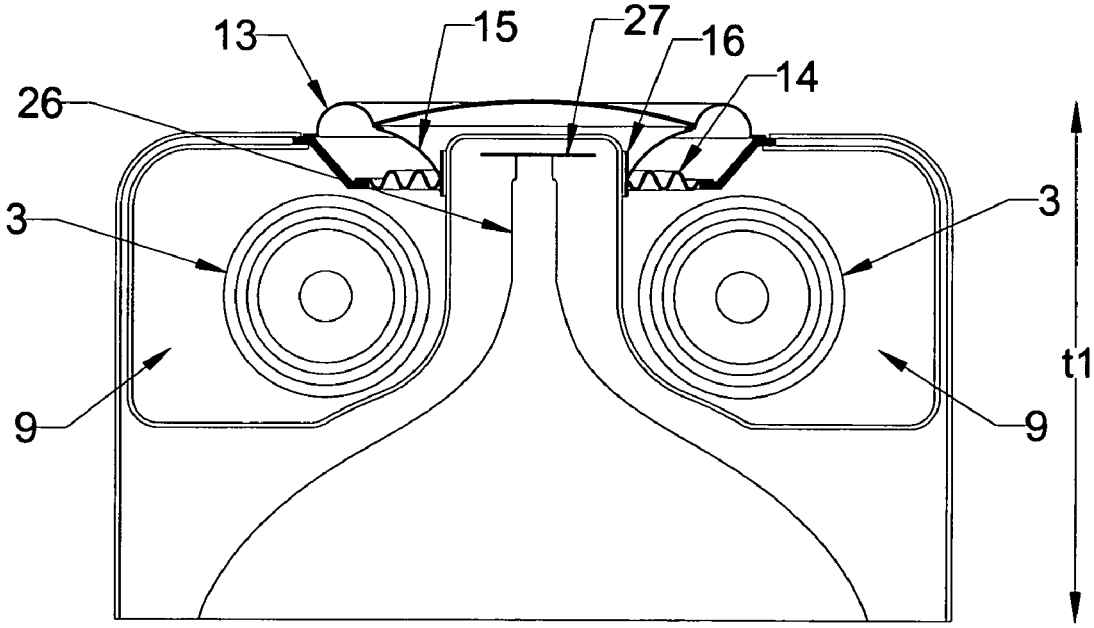
FIG. 11 is a top cross-sectional view of one embodiment of the contoured passive radiator mounted at the back of a television set for high audio power.

FIG. 11 illustrates an example using a contoured passive radiator for a flat-back television set 1 with limited depth $t_1$. Numeral 15 denotes a supporting structure joined with a spider 14 with a hollow structure 16 connected thereto. The cross-section of the hollow structure 16 may be circular (FIG. 12*a*), a rounded rectangle (FIG. 12*b*), ovular (FIG. 12*c*) or elliptical (FIG. 12*d*). The area of hollow structure is relatively wide for positioning of the CRT module board 27. Compliance of passive radiator is determined by both compliance of the surround member and the spider 14. This arrangement is most suitable for high powered audio and particularly for significant diaphragm movement.

Figure 13A:
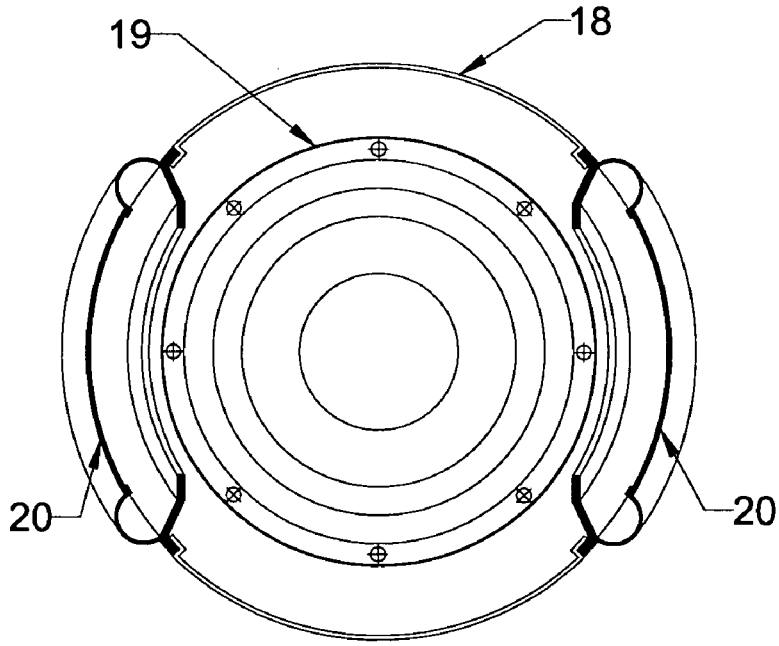
FIG. 13*a* is a plan view of an embodiment of the cylindrical subwoofer according to the present invention with one or more contoured passive radiators.
Figure 13B:
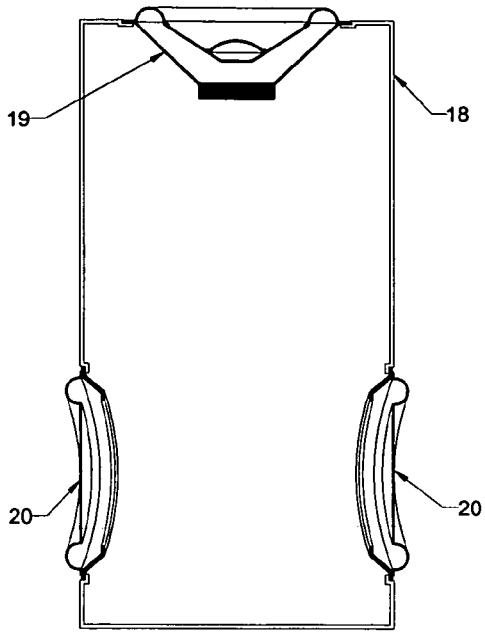
FIG. 13*b* is a cross-sectional view of FIG. 13*a;*

The passive radiator 10 according to the present invention may be used for audio components, high fidelity loudspeakers, home theater loudspeakers, subwoofers, etc. FIGS. 13*a* through 13*f* generally represent a subwoofer having a cylindrical enclosure with a contoured passive radiator. FIG. 13*a* is a top view and FIG. 13*b* is a side view; numeral 18 denotes a cylindrical subwoofer loudspeaker enclosure. The enclosure has one or more woofer drivers 19 and one or more contoured passive radiators 20 that follow the contour of loudspeaker enclosure. FIG. 13*e* is a perspective view of the subwoofer with contoured passive radiator.

Figure 13C:
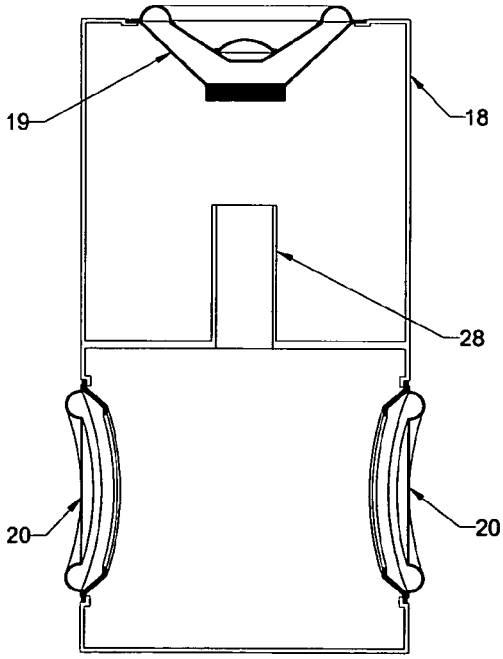
FIG. 13*c* is a cross-sectional view of another embodiment of a cylindrical subwoofer according to the present invention with a bass reflex system inside the enclosure and one or more contoured passive radiators.
Figure 13D:
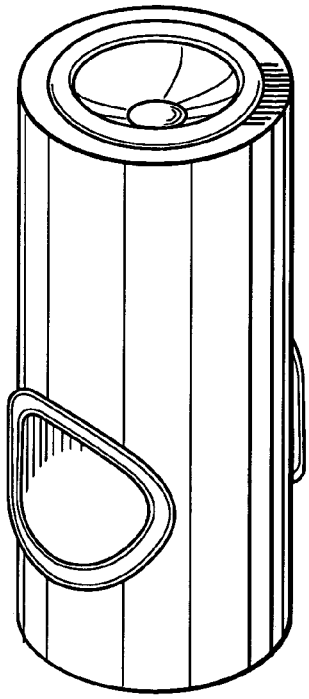
FIG. 13*d* is a perspective view of the cylindrical subwoofer illustrated in FIGS. 13*b* and 13*c;*
Figure 13E:
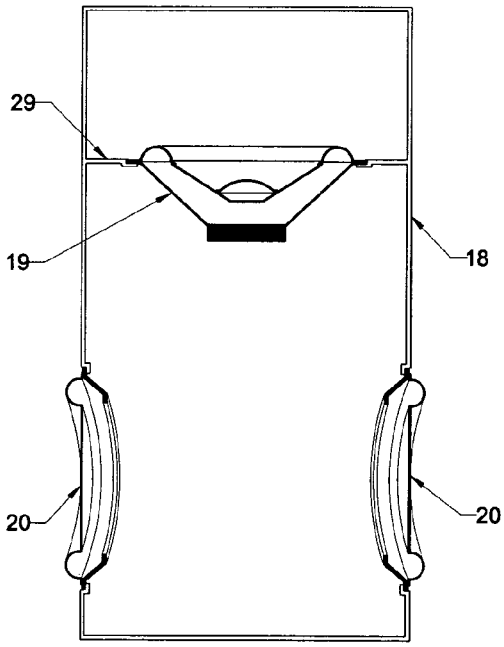
FIG. 13*e* is a cross-sectional view of the cylindrical subwoofer of the present invention with one or more contoured passive radiators.

FIG. 13*c* illustrates an example of another passive radiator which can be used with a cylindrical subwoofer. Numeral 18 denotes a cylindrical subwoofer loudspeaker enclosure, having a bass reflex port 28 and one or more contoured passive radiators 20. FIG. 13*d* is a perspective view of the subwoofer with contoured passive radiator illustrated in FIG. 13*b* and FIG. 13*c*.

Figure 13F:
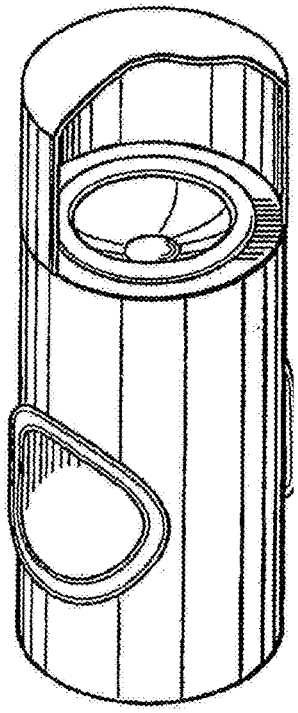
FIG. 13*f* is a perspective view of the cylindrical subwoofer illustrated in FIG. 13*e;*

FIG. 13*e* illustrates an example of subwoofer with a fourth order cylindrical band pass enclosure. Numeral 29 denotes a separator enclosure for supporting one or more woofer drivers 19. (FIG. 13*d* used only one woofer driver). Two passive radiators are attached at the side of enclosure. The perspective view of the band pass subwoofer is shown in FIG. 13*f*.

Figure 14A:
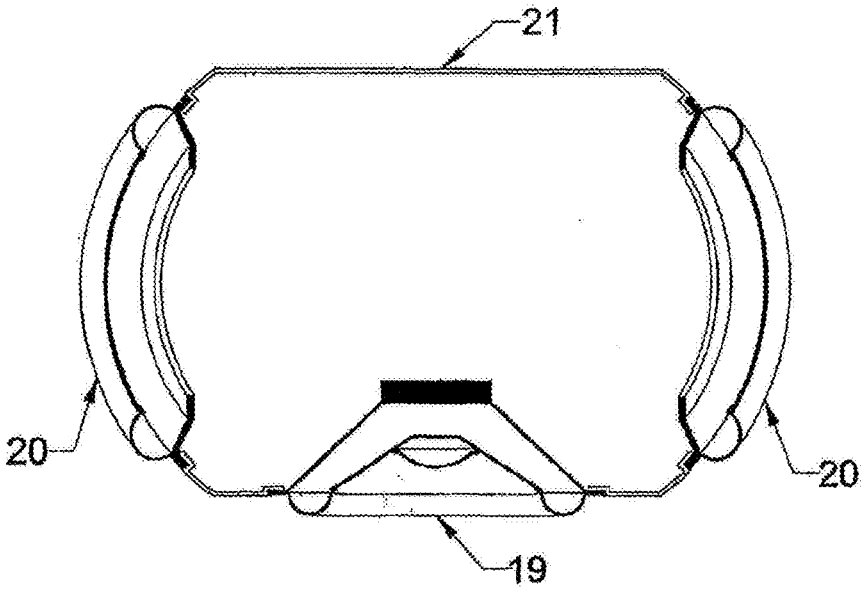
FIG. 14*a* is a top cross-sectional view of one embodiment of a home theater loudspeaker according to the present invention with at least two contoured passive radiators mounted at the sides of the enclosure.
Figure 14B:
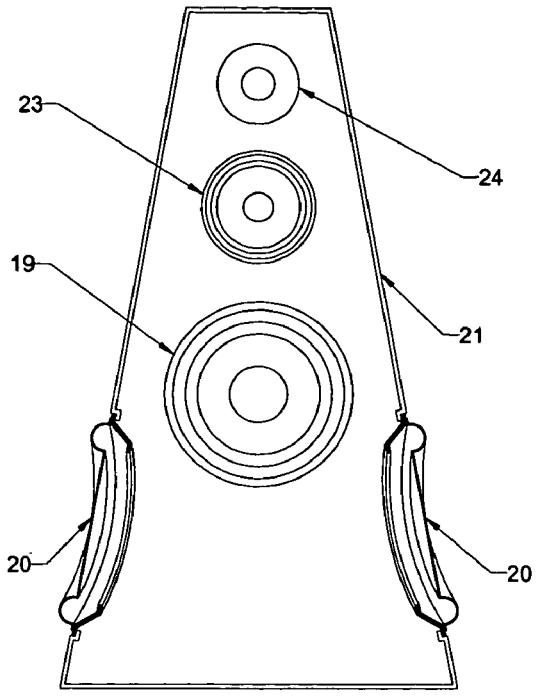
FIG. 14*b* is a side view of FIG. 14*a*.

Referring to FIG. 14*a*, shown is a top view, and side view in FIG. 14*b*, of a home theater loudspeaker using the contoured passive radiator. Numeral 21 denotes a loudspeaker enclosure having a contour at both sides. The enclosure has at least one or more woofer loudspeakers 19, at least one or more midrange loudspeakers 23, at least one or more tweeter loudspeakers 24 and at least one or more contoured passive radiators 20 following the contour of loudspeaker enclosure 21 within which the passive radiator is mounted.

Figure 15A:
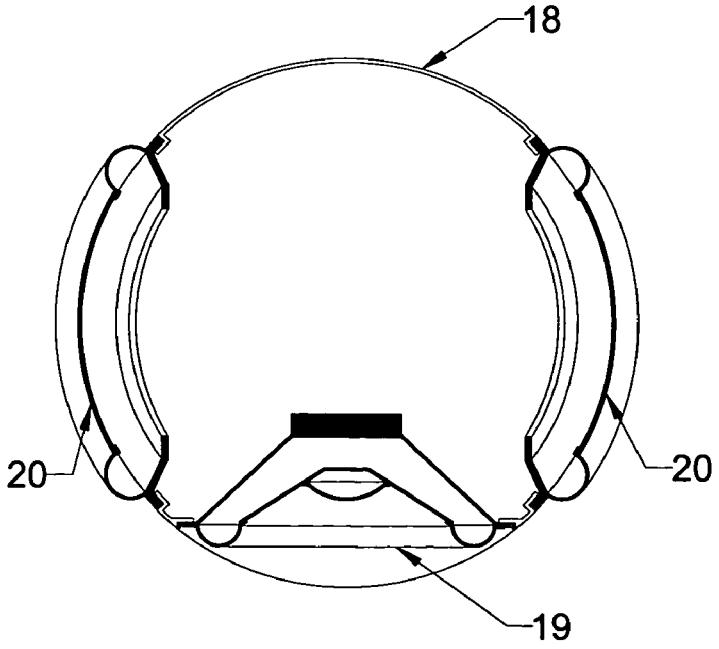
FIG. 15*a* is a top cross-sectional view of one embodiment of the cylindrical home theater loudspeaker enclosure according to the present invention with at least two contoured passive radiators mounted at the sides of the enclosure, with FIG. 15*a* illustrating a top view and FIG. 15*b* a front view.
Figure 15B:
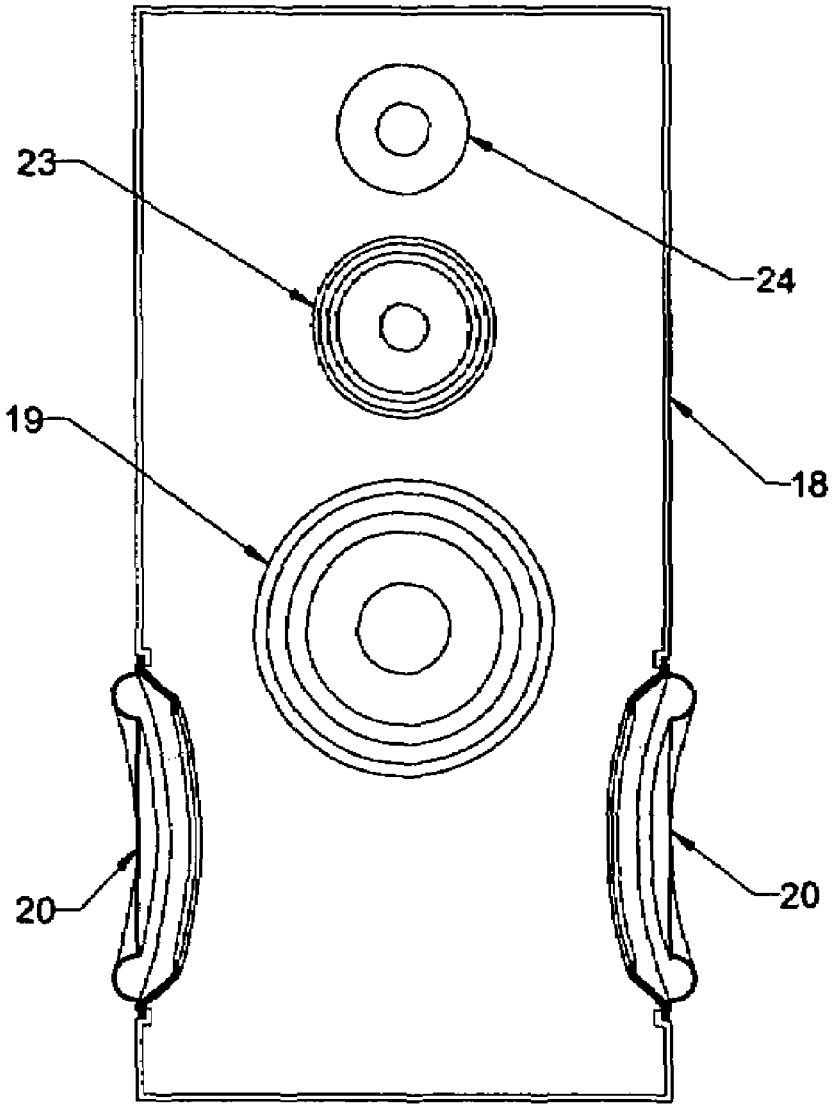

FIGS. 15*a* and 15*b* show views of a high-fidelity loudspeaker using the contoured passive radiator 20. Numeral 18 denotes a cylindrical loudspeaker enclosure. The enclosure has at least one or more woofer loudspeakers 19, at least one or more midrange loudspeakers 23, at least one or more tweeter loudspeakers 24 and at least one or more contoured passive radiators 22 following the contour of loudspeaker enclosures.

In terms of the material for the passive radiator diaphragm, the same can be fabricated from paper, polypropylene, homopolymers, copolymers, composite materials, polyblends, ceramic, carbon, rubber, fibered material, aluminum, or other materials suitable for diaphragm fabrication. The material for the surround passive radiator may be made from rubber, acoustic foam, cloth, paper or other suitable material.

Although embodiments of the invention have been described above, it is limited thereto and it will be apparent to those skilled in the art that numerous modifications form part of the present invention insofar as they do not depart from the spirit, nature and scope of the claimed and described invention.

We claim:

1. A passive radiator for use in an audio or video component having an enclosure and means for retaining a loudspeaker driver, said radiator for increasing the sound pressure level of sound delivered by said loudspeaker, said radiator comprising:

a passive radiator diaphragm having an arcuate contour for following a contour of said enclosure;

a supporting frame extending around said diaphragm; and a surround member connected to said frame and said diaphragm to permit compliance of said diaphragm.

2. The passive radiator as set forth in claim 1, wherein said diaphragm has a circular rim shape.

3. The passive radiator as set forth in claim 1, wherein said diaphragm has a rounded rectangle rim shape.

4. The passive radiator as set forth in claim 1, wherein said diaphragm has an elliptical rim shape.

5. The passive radiator as set forth in claim 1, wherein said diaphragm has an ovular rim shape.

6. The passive radiator as set forth in claim 1, wherein said diaphragm has a convex contour.

7. The passive radiator as set forth in claim 1, wherein said diaphragm has a parabolic contour.

8. The passive radiator as set forth in claim 1, wherein said diaphragm has a hyperbolic contour.

9. The passive radiator as set forth in claim 1, in combination with a loudspeaker having an enclosure and a loudspeaker driver.

10. The passive radiator as set forth in claim 9, in combination with a television monitor having an enclosure.

11. The passive radiator as set forth in claim 1, wherein said diaphragm comprises a material selected from the group consisting of paper, ceramic, fibered material, composite material, a homopolymer, a copolymer, rubber, a polyblend, carbon, aluminum, magnesium or a combination thereof.

12. A passive radiator for use in an audio or video component having an enclosure and means for retaining a loudspeaker driver, said radiator for increasing the sound pressure level of sound delivered by said loudspeaker, said radiator comprising:

a passive radiator diaphragm having an arcuate contour for following a contour of said enclosure;

a supporting frame extending around said diaphragm;

a surround member connected to said frame and said diaphragm to permit compliance of said diaphragm;

a spider; and a hollow structure connected to said spider and said supporting frame.

13. The passive radiator as set forth in claim 12, wherein said hollow structure having a cross-sectional shape is selected from the group consisting of a circle, rounded rectangle or oval.

14. The passive radiator as set forth in claim 13, in combination with a visual monitor.

15. The passive radiator as set forth in claim 14, wherein said hollow structure houses a CRT circuit board.

16. The passive radiator as set forth in claim 12, wherein said diaphragm has a circular rim shape.

17. The passive radiator as set forth in claim 12, wherein said diaphragm has a rounded rectangular rim shape.

18. The passive radiator as set forth in claim 12, wherein said diaphragm has an elliptical rim shape.

19. The passive radiator as set forth in claim 12, wherein said diaphragm has an ovular rim shape.

20. The passive radiator as set forth in claim 12, wherein said diaphragm has a convex contour.

21. The passive radiator as set forth in claim 12, wherein said diaphragm has a parabolic contour.

22. The passive radiator as set forth in claim 12, wherein said diaphragm has a hyperbolic contour.

23. The passive radiator as set forth in claim 12, in combination with a loudspeaker having an enclosure and a loudspeaker driver.

24. The passive radiator as set forth in claim 12, in combination with a television monitor having an enclosure.

25. The passive radiator as set forth in claim 1, wherein said diaphragm comprises a material selected from the group consisting of paper, ceramic, fibered material, composite material, a homopolymer, a copolymer, rubber, a polyblend, carbon, aluminum, magnesium or a combination thereof.

26. A method of increasing the bass frequency sound pressure level of a loudspeaker within an enclosure, comprising the steps of:

providing a loudspeaker enclosure having a loudspeaker driver mounted therein;

providing a passive radiator having a diaphragm and a support therefor, said diaphragm having an arcuate contour and being compliant upon exposure to a signal;

mounting said passive radiator into said loudspeaker enclosure; and passing a bass signal through said loudspeaker driver whereby the bass frequency sound pressure level of the loudspeaker is increased.

27. The method as set forth in claim 26, wherein said loudspeaker enclosure is contoured.

28. The method as set forth in claim 27, wherein said contour of said enclosure and said contour of said diaphragm are similar.

29. The method as set forth in claim 27, wherein said contour of said enclosure and said contour of said diaphragm are identical.

30. The method as set forth in claim 26, further including the step of mounting at least two passive radiators in said loudspeaker enclosures.

* * * * *